US005610480A

United States Patent [19]

Takayanagi

[11] Patent Number: 5,610,480

[45] Date of Patent: Mar. 11, 1997

[54] CONTROL APPARATUS FOR COPYING MACHINE OR THE LIKE

[75] Inventor: Yoshiaki Takayanagi, Ichikawa, Japan

[73] Assignee: Canon Kabushiki Kaisha, Tokyo, Japan

[21] Appl. No.: 476,766

[22] Filed: Jun. 7, 1995

Related U.S. Application Data

[62] Division of Ser. No. 164,837, Dec. 9, 1993, which is a continuation of Ser. No. 831,636, Feb. 10, 1992, abandoned, which is a continuation of Ser. No. 515,321, Apr. 30, 1990, abandoned, which is a continuation of Ser. No. 253,426, Oct. 4, 1988, abandoned, which is a continuation of Ser. No. 33,881, Apr. 2, 1987, abandoned, which is a continuation of Ser. No. 637,789, Aug. 9, 1984, abandoned.

[30] Foreign Application Priority Data

| | | | |
|---|---|---|---|
| Aug. 13, 1983 | [JP] | Japan | 147291 |
| Aug. 13, 1983 | [JP] | Japan | 147300 |
| Aug. 13, 1983 | [JP] | Japan | 147301 |

[51] Int. Cl.[6] ..... G05F 1/00

[52] U.S. Cl. ..... 315/308; 315/307; 315/293; 315/158; 355/69; 399/51

[58] Field of Search ..... 315/306, 307, 315/308, 309, 158, 291, 293, 299, 241; 355/228, 229, 69

[56] References Cited

U.S. PATENT DOCUMENTS

| | | | |
|---|---|---|---|
| 3,600,657 | 8/1971 | Pfaff et al. | 323/244 |
| 4,158,164 | 6/1979 | Nutz | 323/243 |
| 4,163,923 | 8/1979 | Herbers | 315/308 |
| 4,320,964 | 3/1982 | Ishida et al. | 315/307 |
| 4,359,670 | 11/1982 | Hosaka et al. | 315/307 |
| 4,370,601 | 1/1983 | Horii et al. | 315/307 |
| 4,426,614 | 1/1984 | Nola | 323/243 |
| 4,457,614 | 7/1984 | Nakajima et al. | 355/228 |
| 4,475,065 | 10/1984 | Bhalla et al. | 315/307 |
| 4,501,994 | 2/1985 | Spreadbury | 315/307 |
| 4,503,364 | 3/1985 | Engel | 315/308 |
| 4,527,093 | 7/1985 | Yamauchi | 315/307 |
| 4,645,982 | 2/1987 | Takayanagi | 315/307 |
| 4,855,648 | 8/1989 | Yagasaki | 355/69 |

*Primary Examiner*—Robert Pascal
*Assistant Examiner*—Haissa Philogene
*Attorney, Agent, or Firm*—Fitzpatrick, Cella, Harper & Scinto

[57] ABSTRACT

A control apparatus for a copying machine or the like, has a halogen lamp for exposing an original, a detection circuit for monitoring a turn-on voltage of the lamp, a comparator for comparing the monitored turn-on voltage with a reference value, a microcomputer having an internal timer, and a memory for storing a phase control amount for a previous exposure operation. The light amount of the halogen lamp can be converged to a target value within a predetermined period of time and without adverse influence of turn ON/OFF operations of other loads such as a motor.

16 Claims, 13 Drawing Sheets

CONTROL APPARATUS FOR COPYING MACHINE OR THE LIKE

This application is a division of application Ser. No. 08/164,837 filed Dec. 9, 1993, now pending, which was a continuation of application Ser. No. 07/831,636 filed Feb. 10, 1992, now abandoned, which was a continuation of application Ser. No. 07/515,321 filed Apr. 30, 1990, now abandoned, which was a continuation of application Ser. No. 07/253,426 filed Oct. 4, 1988, now abandoned, which was a continuation of application Ser. No. 07/033,881 filed Apr. 2, 1987, now abandoned, which was a continuation of application Ser. No. 06/637,789 filed Aug. 6, 1984, now abandoned.

BACKGROUND OF THE INVENTION

1. Field of the Invention

The present invention relates to a control apparatus for a copying machine or the like and, more particularly, to a control section for controlling a light amount of a light source which emits light upon supply of current thereto.

2. Description of the Prior Art

Power control of a halogen lamp for original exposure in a copying machine or the like is conventionally performed by phase control using a lamp regulator (CVR). A CVR is complex in circuit configuration and is large in size. Moreover, when the power source voltage varies, the turn-on voltage of a halogen lamp also varies, as shown in FIG. 1. Referring to FIG. 1, curve I represents a power source voltage, and curve II represents a turn-on voltage of a halogen lamp. As may be seen from this graph, since the turn-on voltage of the halogen lamp varies with a change in the power source voltage, when a halftone image is reproduced, a reproduced copy image has an irregular density.

In order to turn on a light source so it produces a desired light amount, a voltage to be applied to the light source must be converged to a desired value within a short period of time. However, if a correction for converging the voltage is performed in the same manner under varying conditions, correction may be time-consuming and correct convergence may not always be achieved.

When turn-on and off of the light source are repeatedly performed, if light amount control is performed from the initial state for each turn-on operation, the time needed for converging the turn-on time is required for each turn-on operation.

When another or other loads must be driven with the same power source as that for driving the light source, the ON/OFF state of the load influences the application voltage on the light source, so that a desired light amount may not be obtained.

When the light source is energized abruptly, the light source is degraded or damaged, resulting in inconvenience. A control method may be adopted wherein a turn-on voltage is gradually increased after the turn-on operation is started. However, if repeated turn ON/OFF operations are performed with this control method, the control operation is time-consuming.

Furthermore, when this control operation is performed in the same manner from the initial state for each turn-on operation, the convergence time for achieving a desired light amount is long.

When a copy is to be reproduced with a different magnification from an original, the image density may vary in accordance with a selected magnification.

Even if the original exposure is performed with a predetermined light amount in a copying machine or the like, an optimal image may not be obtained depending upon the image state of the original.

SUMMARY OF THE INVENTION

The present invention has been made in consideration of this and has as its object to provide a control apparatus for a copying machine or the like which can perform excellent light amount control of a light source.

It is another object of the present invention to converge a light amount of a light source to a desired light amount within a short period of time.

It is still another object of the present invention to obtain a desired light amount fast and reliably in each turn-on operation when a light source is repeatedly turned on and off.

It is still another object of the present invention to eliminate the adverse effect of a load other than a light source on a light amount thereof.

It is still another object of the present invention to provide a control apparatus which is suitable for controlling a light amount of a light source for an original exposure of a copying machine or the like.

The above and other objects, features and effects of the present invention will become apparent from the following description taken in conjunction with the accompanying drawings.

DETAILED DESCRIPTION OF THE PREFERRED EMBODIMENTS

The preferred embodiment of the present invention will be described wherein the present invention is applied to light amount control of an original exposure lamp of a copying machine.

Figure 2:
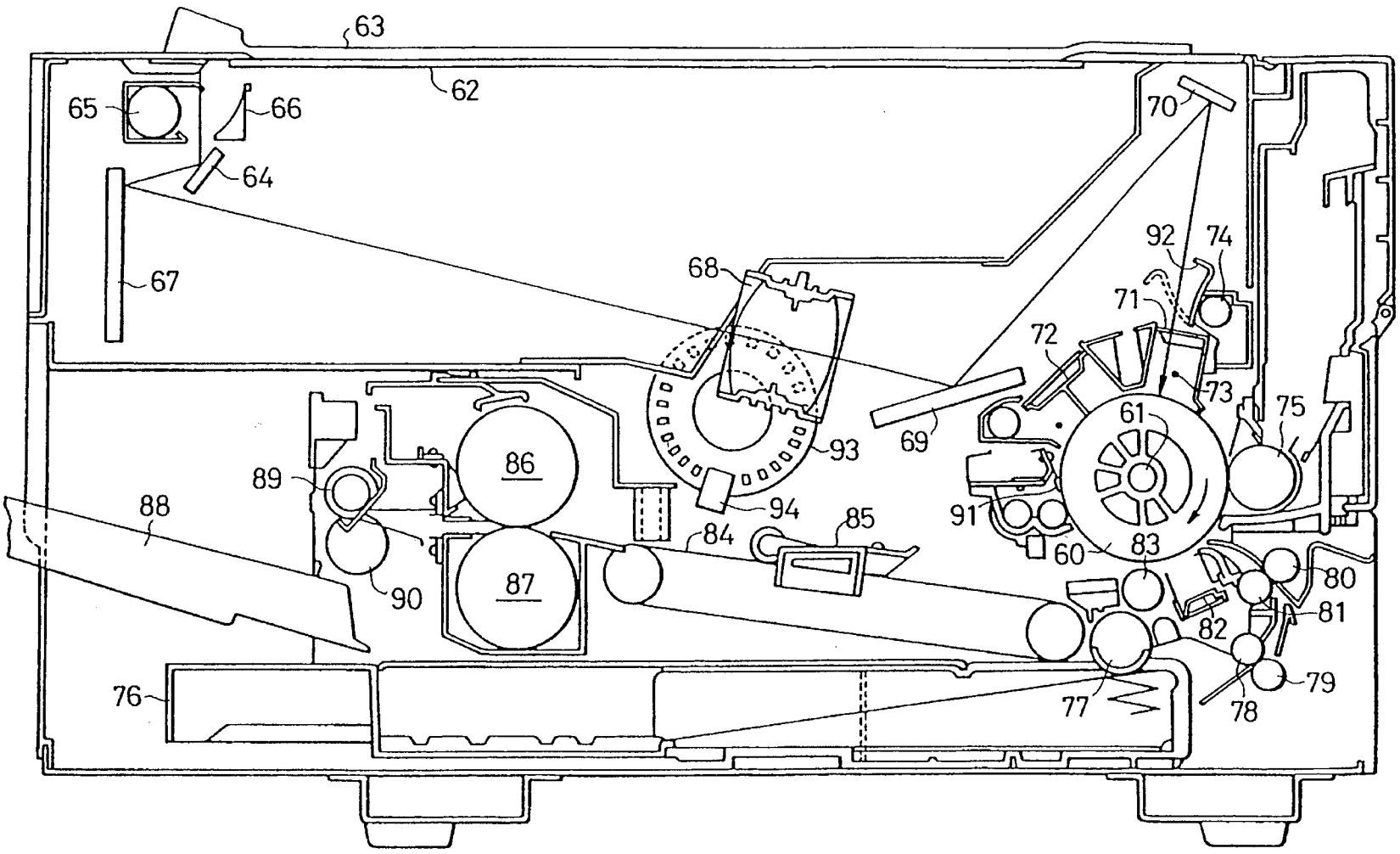
FIG. 2 is a sectional view showing the construction of a copying machine to which the present invention is applied.

FIG. 2 is a schematic view of a copying machine to which the present invention is applied. In this embodiment, the present invention is applied to a copying machine of the type wherein the original table is fixed in position. The present invention is similarly applicable to a copying machine of the type wherein the original table is movable.

The surface of a photosensitive drum 60 comprises a photoconductive layer, is rotatably supported on a shaft 61, and can therefore be rotated in the direction indicated by the arrow in response to a copy instruction.

When the photosensitive drum 60 is rotated to a predetermined position, an original fixed on an original glass table 62 and held in position by an original cover 63 is irradiated with light illuminated from an illumination lamp 65 formed integrally with a first mirror 64 and reflected from a main reflector 66. The reflected light is scanned by the first mirror 64 and a second mirror 67. The first and second mirrors 64 and 67 move at a speed ratio of 1:½. Thus, the original is scanned with the optical path length in front of a lens 68 kept constant.

The reflected light image is formed on the portion of the photosensitive drum 60 corresponding to an exposure unit 71 through the lens 68, a third mirror 69, and a fourth mirror 70.

The photosensitive drum 60 is charged (e.g., positively) by a primary charger 72 and is slits exposed to the image illuminated by the illumination lamp 65 at the exposure unit 71.

At the same time, AC charge removal or charge removal of the opposite polarity (e.g., negative) to that of the primary charger is performed by a charge remover 73. Thereafter, the photosensitive drum 60 is uniformly exposed by an entire surface exposure lamp 74 so as to form a high-contrast electrostatic latent image thereon. The latent image on the photosensitive drum 60 is visualized as a toner image by a developing unit 75.

A transfer sheet P (not shown) in a cassette 76 is picked up by a pick-up roller 77 and is supplied into the copying machine. The transfer sheet P is further conveyed to register rollers 80 and 81 through convey rollers 78 and 79. The transfer sheet P is thus adjusted in feed timing by the register rollers 80 and 81 and is supplied toward the photosensitive drum 60.

While the transfer sheet P is passed through a gap between a transfer charger 82 and the photosensitive drum 60, a toner image on the photosensitive drum 60 is transferred onto the transfer sheet P.

After this transfer operation, the transfer sheet P is separated from the photosensitive drum 60 by a separation roller 83 and is guided to a conveyor belt 84. The conveyor belt 84 has a paper press roller 85. The transfer sheet P is then guided between fixing rollers 86 and 87 and the image thereon is fixed. The transfer sheet P is finally exhausted onto a tray 88 through exhaust rollers 89 and 90.

Meanwhile, after the transfer operation, the photosensitive drum 60 is cleaned by a Cleaning unit comprising an elastic blade 91 and is prepared for the next image forming cycle. A blank shutter 92 is for selecting between the image exposure onto the photosensitive drum 60 or for blank exposure.

In order to control the timing of the copying operation, there are provided a clock plate 93 rotatable in synchronism with a main motor (not shown), and a photointerruptor 94 for detecting the rotation of the clock plate 93. A signal from the photointerruptor 94 is supplied to a microcomputer which controls the copying operation in accordance with the received signal.

The size of the reproduced image with respect to the original image can be changed (enlarged or reduced) by-changing the moving speed of the first mirror 64, the illumination lamp 65 or the second mirror 67 or by changing the position of the lens 68. The magnification of the image can be manually set by the operator or can be automatically set in accordance with the sizes of the original and the transfer sheet. The moving speed of the mirror and the like and the position of the lens are determined in accordance with the magnification set in either manner.

Figure 3:
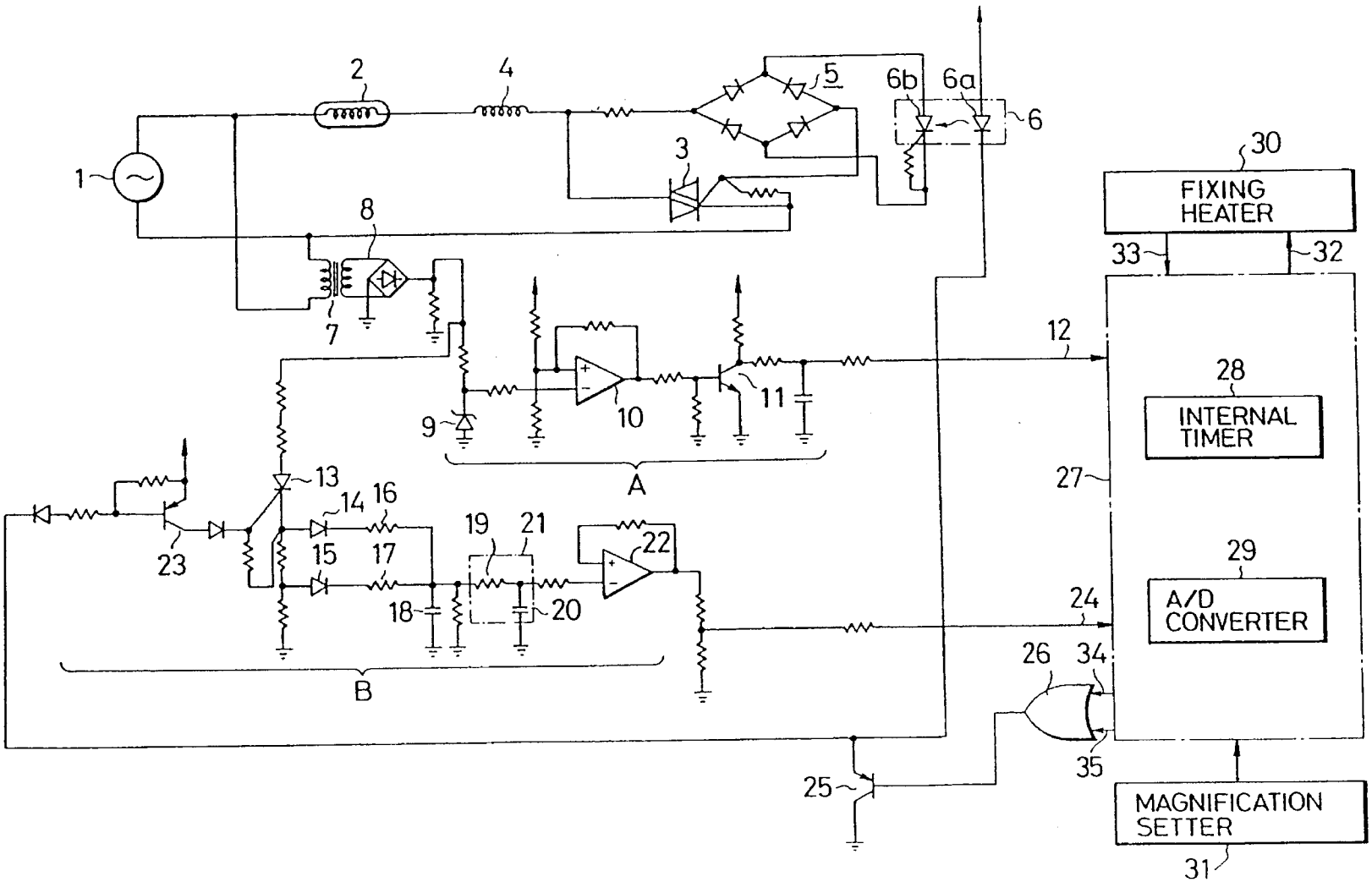
FIG. 3 is a circuit diagram of a lamp control apparatus according to an embodiment of the present invention.

FIG. 3 is a circuit diagram of a control circuit for the illumination lamp 65 shown in FIG. 2 according to an embodiment of the present invention. Those parts which are not directly associated with the present invention are omitted from the drawing.

Referring to FIG. 3, the control circuit includes a power source 1 (commercial AC power source), a halogen lamp 2, a TRIAC 3, a choke coil 4, and a rectifying circuit 5 and a trigger element 6 for controlling the phase of the gate of the TRIAC 3. The trigger element 6 consists of a light-emitting diode (LED) **6*a* and a photo thyristor 6*b*. Another rectifying circuit 8 is connected to the secondary side of a power source voltage monitor transformer 7. An output from the transformer 7 is supplied to a Zener diode 9, a comparator 10, and a transistor 11. The Zener diode 9, the comparator 10 and the transistor 11 constitute a zero crossing circuit A. The zero crossing circuit A generates zero crossing pulse signals 12 at the zero crossing points of each cycle of the AC voltage supplied from the power source 1**.

The circuit further includes a thyristor 13, diodes 14 and 15, resistors 16 and 17, a capacitor 18, a resistor 19, a capacitor 20, an operational amplifier 22, a transistor 23, a switching transistor 25, and an OR circuit 26. The resistor 19 and the capacitor 20 constitute a low-pass filter 21. The parts 13 to 23 constitute an effective value detection circuit B which produces a turn-on voltage monitor signal 24.

A one-chip 8-bit microcomputer 27 has an internal timer 28, an A/D converter 29 and the like. A fixing heater 30 and a magnification setter 31 are connected to the microcomputer 27. The fixing heater 30 is started in response to an ON signal 32 from the microcomputer 27. The heater temperature is supplied to the microcomputer 27 by a temperature detection signal 33 from a temperature sensor (not shown) arranged near the fixing rollers incorporating the fixing heater 30 therein. The microcomputer 27 also generates an exposure signal 34 and a trigger signal 35. Those parts which do not need reference numerals are not designated by any.

The operation of the copying machine will be described in the order of the operation of the zero crossing circuit A, the turn-on operation of the halogen lamp 2, and the operation of the effective value detection circuit B. The control sequence of the microcomputer 27 will be described with reference to a flow chart later.

First, the operation of the zero crossing circuit A will be described. An output from the rectifying circuit 8 connected to the secondary side of the monitor transformer 7 is supplied to the inverting input terminal of the comparator 10. The non-inverting input terminal of the comparator 10 receives a predetermined resistance-divided voltage. When the input voltage received at the inverting input terminal coincides with that received at the noninverting input terminal, a zero crossing point is detected and a zero crossing point detection signal is produced from the comparator 10. The signal from the comparator 10 is amplified by the transistor 11, and is supplied from the transistor 11 to the microcomputer 27 as the zero crossing pulse signal 12. The microcomputer 27 is interrupted every time the zero crossing pulse signal 12 is received.

Figure 4:
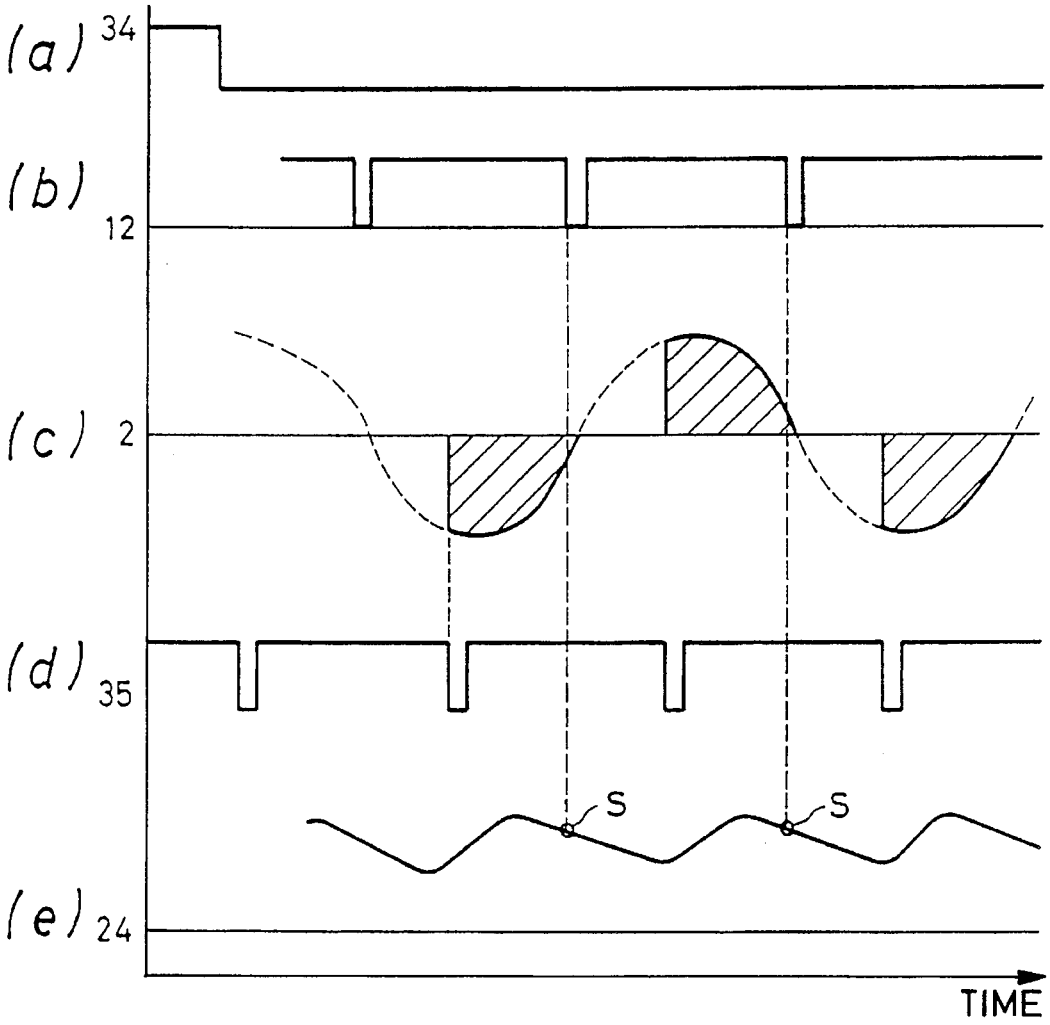
FIG. 4(*a–e*) is a timing chart for explaining the mode of operation of the embodiment shown in FIG. 3.

The zero crossing pulse signal 12 has a waveform b shown in FIG. 4, which corresponds to the zero crossing point of the power source 1 having a waveform c indicated by the dotted line.

The turn-on operation of the halogen lamp 2 shown in FIG. 3 will be described below. When the exposure signal 34 and the trigger signal 35 having waveforms a and d shown in FIG. 4 are produced from the microcomputer 27, they are supplied to the base of the switching transistor 25 through the OR circuit 26 to turn on the transistor 25. Then, the LED 6*a* of the trigger element 6 is turned on. Light from the LED 6*a* becomes incident on the photo thyristor 6*b* which is then turned on. An output from the rectifying circuit 5 is applied to the gate of the TRIAC 3 to turn it on. A voltage from the power source 1 is applied to the halogen lamp 2 through the choke coil 4 to turn on the lamp 2. The hatched portion of the waveform c shown in FIG. 4 is the waveform of the voltage applied to the halogen lamp 2. The rising edge of the voltage applied to the lamp 2 coincides with the application timing of the trigger signal 35 having the waveform d shown in FIG. 3. Therefore, the turn-on timing of the halogen lamp 2 can be changed by changing the application timing of the trigger signal 35.

The operation of the effective value detection circuit B will be described below. When the transistor 25 is turned on and the LED 6*a* emits light, the transistor 23 is turned on and a voltage is applied to the gate of the thyristor 13 to turn it on. Therefore, an output from the rectifying circuit 8 charges the capacitor 18 through the diodes 14 and 15. However, since the potential at the diode 15 is lower than that at the diode 14, charging from the diode 15 is completed earlier than that from the diode 14. After charging from the diode 15 is terminated, charging is continued from the diode 14. Thus, the terminal voltage across the capacitor 18 is supplied as the turn-on voltage monitor signal 24 (e in FIG. 4) to the microcomputer 27 by a voltage follower comprising the operational amplifier 22 through the low-pass filter 21. The capacitor 18 is charged through the parallel resistors 16 and 17 for the following reason. When the turn-on voltage waveform for the halogen lamp 2 at the secondary side of the monitor transformer 7 is integrated by a single CR circuit, average value detection is performed. If the detected average value or mean value is used as an effective value, a non-negligible error occurs with reference to the phase angle of the turn-on voltage of the halogen lamp 2. Then, the value cannot be used as the turn-on voltage of the halogen lamp 2. In order to prevent this, the resistances of the resistors 16 and 17 are properly selected so as to charge the capacitor 18 therefrom, so that an approximate value of the effective value of the turn-on voltage of the halogen lamp 2 is detected.

Every time the zero crossing pulse signal 12 is supplied to the microcomputer 27, an interruption is effected. The effective value of the voltage at a sampling point S as indicated in the waveform e in FIG. 4 is detected and is supplied as the turn-on voltage monitor signal 24 to the microcomputer 27. The application timing of the trigger signal 35 is controlled by the microcomputer 27 such that the voltage represented by the turn-on voltage monitor signal 24 coincides with a target value.

Phase control by the microcomputer 27 will be described with reference to the flow charts shown in FIGS. 5 and 6(*a*) to 6(*c*). In these flow charts, reference symbol F denotes a flag. The programs of these flow charts are written in a RAM of the microcomputer 27.

Figure 5:
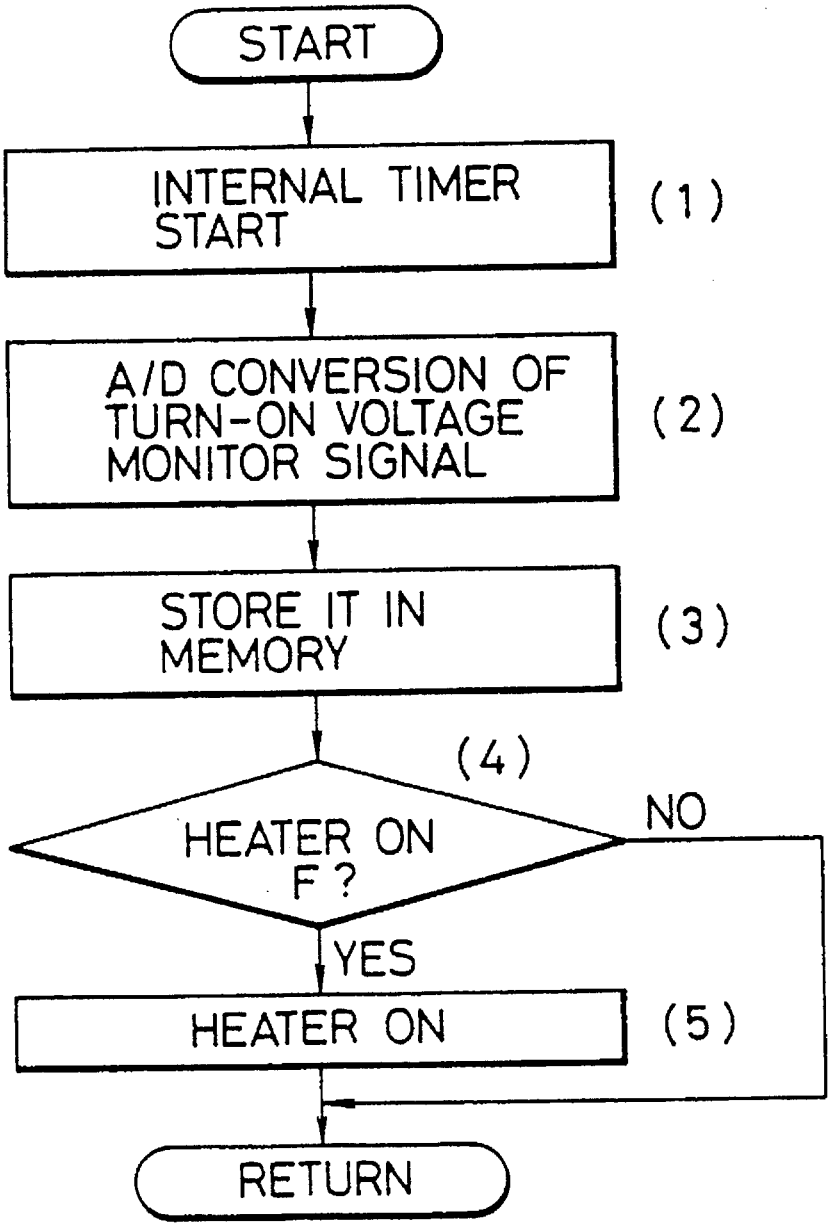
FIG. 5 is a flow chart of an external interruption routine.

FIG. 5 shows an external interruption flow chart by the zero crossing pulse signal 12.

When the zero crossing pulse signal 12 is received, the internal timer 28 for providing a reference for phase control is started in step (1). Then, the turn-on voltage monitor signal 24 is A/D converted by the A/D converter 29 in step (2), and the digital signal is stored in a memory in step (3). The ON/OFF status of the fixing heater 30 is checked by checking a heater ON flag F in step (4). If the heater ON flag F is set, the fixing heater 30 is turned on in step (5).

Figure 6A:
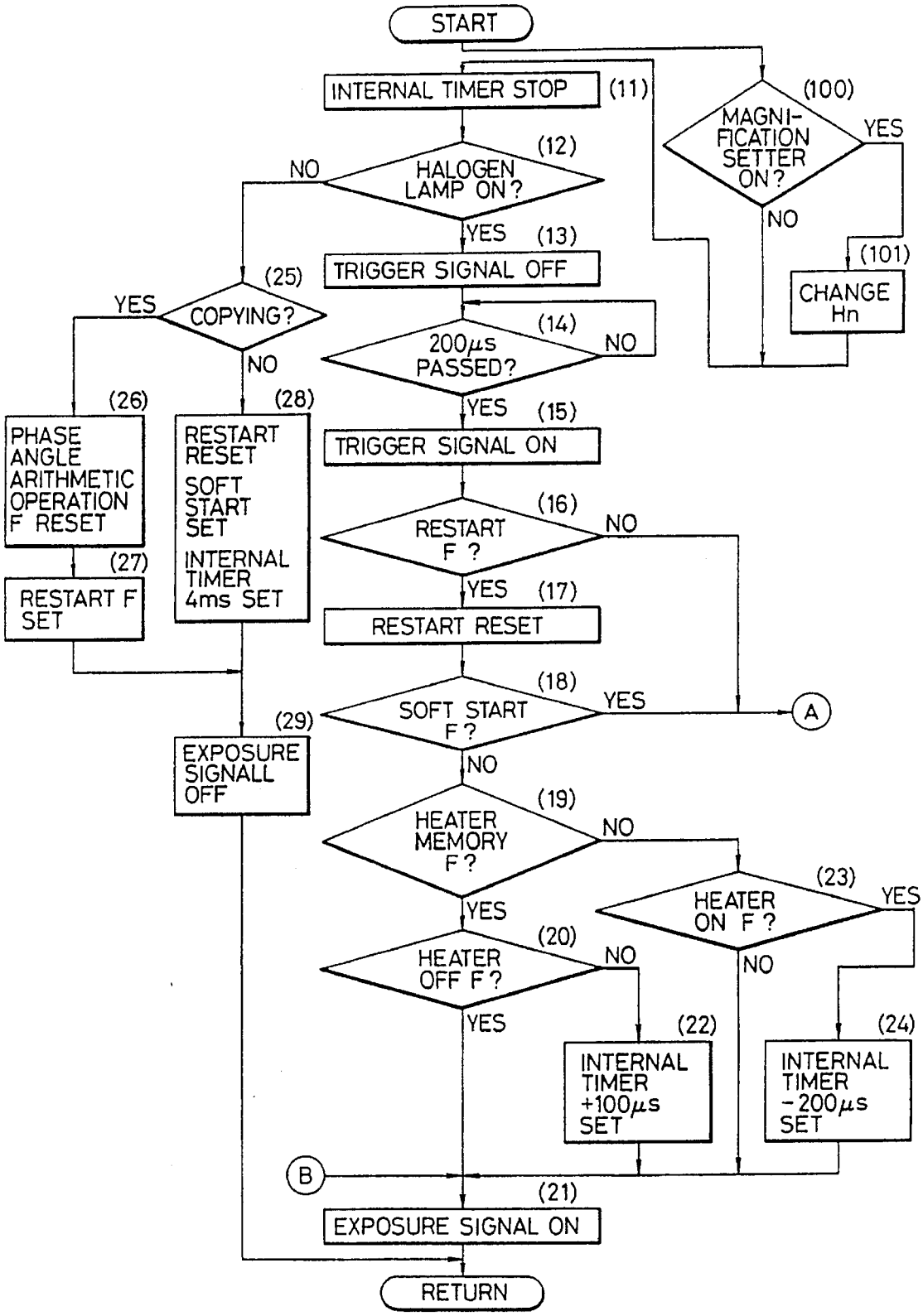
FIGS. 6(*a*) to 6(*c*) are views showing an internal timer interruption routine.
Figure 6B:
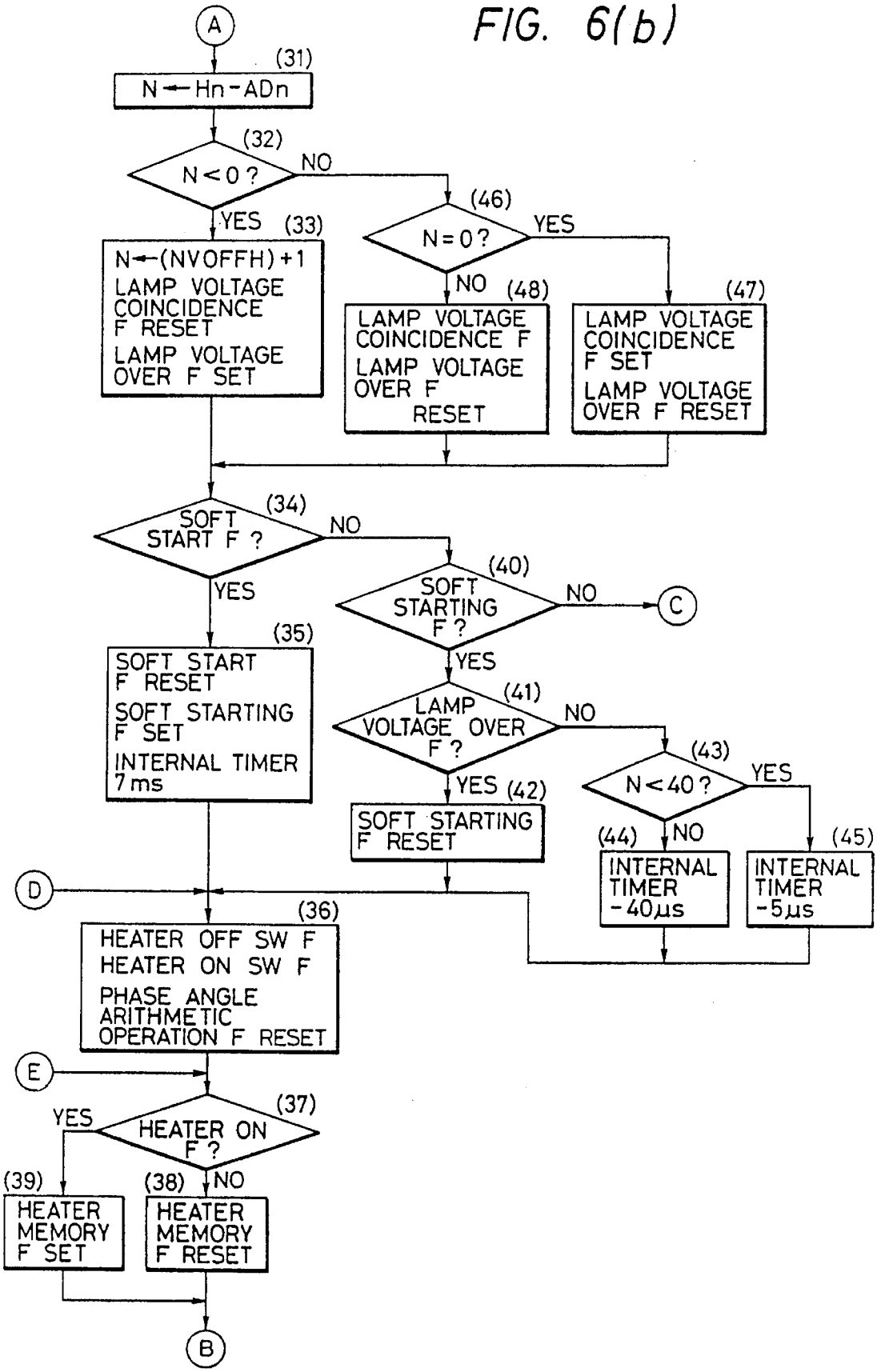
Figure 6C:
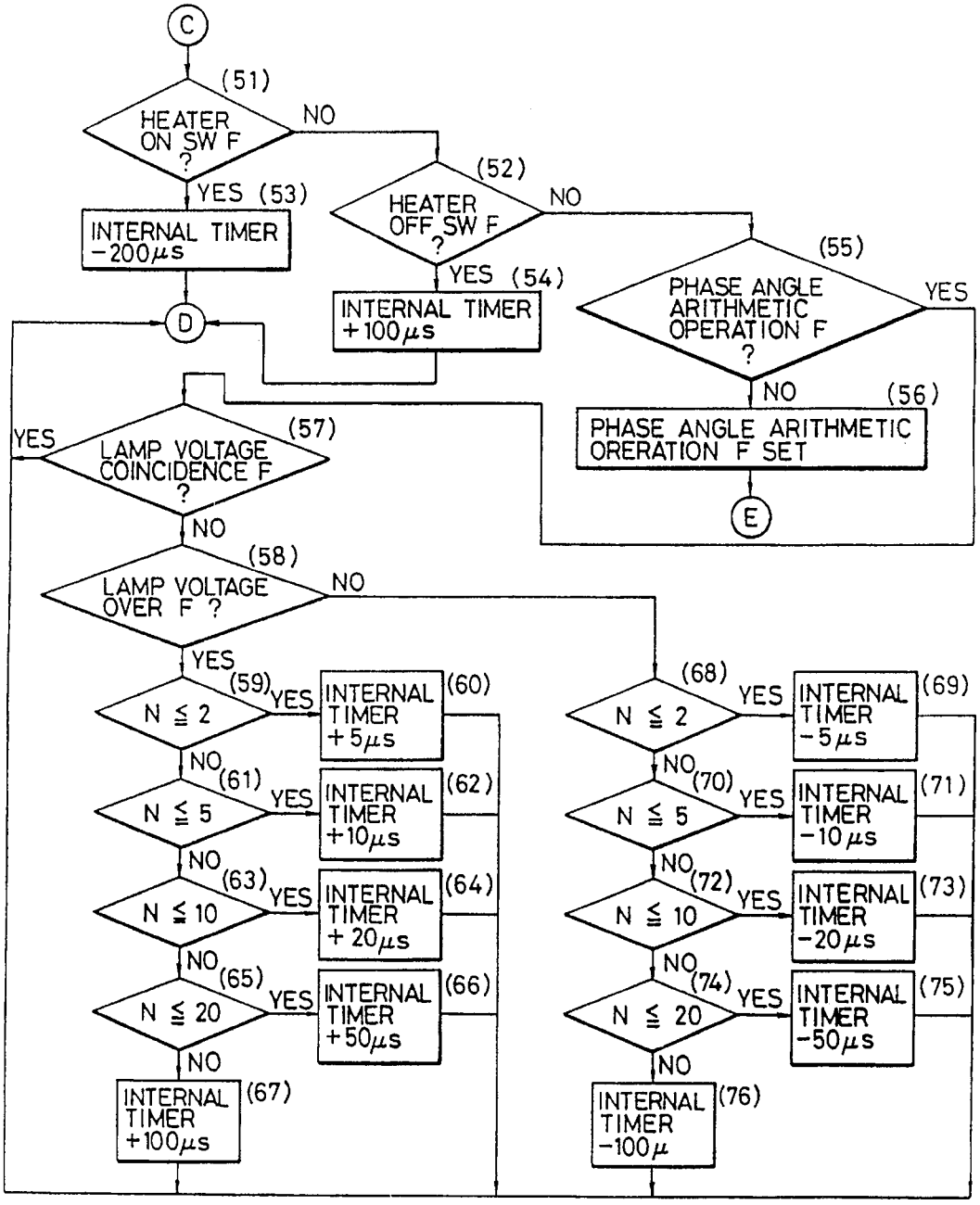

FIGS. 6(*a*) to 6(*c*) show an internal timer interruption routine of the internal timer 28. A description will be made starting from FIG. 6(*a*).

The magnification of the image is changed by the magnification setter 31 before the halogen lamp 2 is turned on.

It is first checked in step (100) if there is a magnification change request. If it is determined that a magnification change request is present, a preset value Hn of the turn-on voltage of the halogen lamp 2 is changed in accordance with the new magnification in step (101). When the preset time in the internal timer has elapsed, the internal timer 28 is stopped in step (11). The ON/OFF status of the halogen lamp 2 is detected in accordance with the set/reset status of the halogen lamp ON flag F in step (12). If YES in step (12), the trigger signal 35 is turned off in step (13). When 200 μs is determined to have elapsed by the microcomputer 27 in step (14), the trigger signal 35 is turned on in step (15). Thus, a trigger pulse having a pulse width of 200 μs is produced. When the trigger signal 35 and the exposure signal 34 are simultaneously supplied to the OR circuit 26 at this time, the halogen lamp 2 is turned on, as described above.

Then, a restart flag F is checked in step (16). The restart flag F is required for original exposure from the second original and thereafter when a multicopy operation is performed. The restart flag F is set when multicopy for a preset number of copies has not been completed. If the restart flag F is not set, the flow advances to the flow chart shown in FIG. 6(*b*) to perform phase angle arithmetic operation. However, if the restart flag F is set, the restart flag F is reset in step (17). It is then checked in step (18) if a soft start flag F is set. If the soft start flag F is not set, the previous phase angle for the previous original exposure operation is read out. At the same time, the ON/OFF status of the fixing heater 30 is checked through the set/reset state of a heater memory flag F in step (19). When the ON/OFF status of the fixing heater 30 and the state of the heater memory flag F coincide with each other (step (20) or (23)), the previous phase angle of the previous original exposure operation is set so as to start turn-on of the halogen lamp 2. However, if the status of the fixing heater 30 and the state of the heater memory flag F do not coincide with each other (and if the fixing heater 30 has changed from the ON status to the OFF status at the end of the previous exposure operation), the phase angle is increased by 100 μs by the internal timer 28 in step (22). If the status of the fixing heater 30 and the state of the heater memory flag F do not coincide with each other (and if the fixing heater 30 has changed from the OFF status to the ON status), the phase angle is decreased by 200 μs by the internal timer 28 in step (24). Through these steps (19) to (24), a change in the light amount of the lamp due to a drop in the voltage from the power source 1 caused by a change in the ON/OFF status of the fixing heater 30 is removed by correcting the phase angle in accordance with the ON/OFF status of the fixing heater 30. The exposure signal 34 is turned on in step (21) so as to turn on the halogen lamp 2 at the phase angle set in this manner.

When it is determined in step (18) that the machine is in the soft start operation, the flow goes to a control routine Ⓐ in FIG. 6(*b*). When it is determined in step (12) that the halogen lamp ON flag F is not set, it is discriminated in step (25) whether the copying machine is performing a copy operation, that is, whether it is in the multicopy operation. If it is determined in step (25) that the copying machine is performing the copy operation, a phase angle arithmetic operation flag F is reset in step (26). The restart flag F is set in step (27), and the exposure signal 34 is turned off in step (29). However, if it is determined in step (25) that the copying machine is not performing a copy operation, the restart flag F is reset and the internal timer 28 is set to 4 ms in step (28). The exposure signal 34 is then turned off in step (29). The internal timer 28 is set to 4 ms in step (28) so as to preset a required time period for requesting an interruption in the internal interruption routine. This value is selected in accordance with the frequency of the commercial power source 1.

As described above, in each copy operation of a plurality of sheets, the previous phase control angle of original exposure is stored and is used for the initial phase control angle of the next original scan. Therefore, the phase control angle can be started from a more accurate value, so that the turn-on voltage can be converged to a suitable value within a short period of time and the lamp life can be prolonged.

Considering that the ON/OFF switching status of the fixing heater 30 influences the fluctuation of the lamp turn-on voltage, the phase control angle of the previous original exposure is used for the initial turn-on voltage of the lamp, so that the phase control angle can be started from a suitable value.

The routine Ⓐ starting from step (16) or (18) will be described with reference to FIG. 6(*b*).

An A/D converted value ADn (8 bits) of the turn-on voltage monitor signal 24 from the A/D converter 29 is subtracted from a preset value Hn (8 bits) as the target of the turn-on voltage of the halogen lamp 2 to provide a subtracted value or quotient N in step (31). The sign of the quotient N is discriminated in step (32). If the quotient N is less than 0 (i.e., negative), a lamp voltage coincidence flag F and a lamp voltage over flag F are reset and set, respectively, in step (33).

Then, the soft start flag F is checked in step (34). Assume that it is determined in step (34) that the soft start flag F is set. Then the soft start flag F is reset, a soft starting flag F is set, and the internal timer 28 is set to 7 ms, in step (35). When a time period of 7 ms is preset, the triggering of the soft start is started at a timing of 7 ms. Then, in step (36), a heater OFF switch flag F, a heater ON switch flag F, and the phase angle arithmetic operation flag F are reset in step (36). The ON/OFF status of the fixing heater 30 is checked in step (37) by checking the heater ON flag F. If it is determined in step (37) that the fixing heater 30 is ON, the heater memory flag F is set in step (39). However, if it is determined in step (37) that the fixing heater 30 is OFF, the heater memory flag F is reset in step (38).

The heater OFF switch flag F and the heater ON switch flag F in step (36) are flags which are set upon ON/OFF switches of the fixing heater 30 when the halogen lamp 2 is turned on.

When it is determined in step (34) that the soft start F is not set, the soft starting flag F representing that soft starting is currently being performed is checked in step (40). If the soft starting flag F is set, the lamp voltage over flag F is checked in step (41). In this case, since the lamp voltage over flag F has been set, the soft starting flag F is reset in step (42), and soft starting is completed. In this embodiment, since the microcomputer 27 is an 8-bit microcomputer, the preset value Hn can be preset in $2^8$=256 levels. When the preset value Hn is expressed as 200 in decimal notation, 80% of this value is 160. This value 160 which is 80% of the preset value Hn is used as a switching timing of the internal timer for soft starting, as will be described later. Therefore, it is checked if the quotient N has become 40 (200–160) (in decimal notation). Decimal 40 is 101000 in binary notation which will be represented by 40LSB. If the preset value Hn is rendered variable in association with a density level, the light amount of the lamp can be changed and the copying density can be rendered variable. On the other hand, if it is determined in step (41) that the lamp voltage over flag F is not set, the soft start operation is continued. When it is determined in step (43) that the quotient N is less than 40 LSB, the internal timer 28 is decreased by 5 μs in step (45). When the quotient N is equal to or larger than 40LSB, the internal timer 28 is decreased by 40 μs in step (44). In this manner, the speed of the soft start is switched in accordance with whether the quotient N as the difference between the preset value Hn for the halogen lamp 2 and the A/D converted value ADn is smaller than 40LSB. The convergence of the voltage to the preset value is performed fast in the range separated from the preset value and is performed slowly in the range near the preset value. As has been described above, since 200LSB is set as the input preset value Hn, the reducing range of the preset value of the internal timer for the soft start is switched from 40 μs to 5 μs in accordance with 80% of the preset voltage of the halogen lamp 2; that is, (200–40)/200(LSB).

When it is determined in step (46) that the preset value Hn and the A/D converted value ADn coincide with each other, that is, N=0, the lamp voltage coincidence-flag F is set, the lamp voltage over flag F is reset, and the flow jumps to step (34). However, if it is determined in step (32) that the preset value Hn is positive, the lamp voltage coincidence flag F and the lamp voltage over flag F are reset in step (48) and the flow jumps to step (34).

Since the turn-on voltage of the lamp can be controlled using a soft start mechanism, an abrupt change in the turn-on voltage of the lamp can be suppressed to the minimum and the lamp lift can be prolonged.

Since the soft start mechanism functions in a stepwise manner, an abrupt change in the turn-on voltage of the lamp is suppressed, and convergence of the turn-on voltage of the lamp to the target value can be achieved fast.

A routine Ⓒ to be executed from step (40) will now be described with reference to FIG. 6(*c*).

The heater ON switch flag F and the heater OFF switch flag F are checked in steps (51) and (52). When it is determined that the heater ON switch flag F is set, the internal timer 28 is decreased by 200 μs in step (53). When it is determined that the heater OFF switch flag F is set, the internal timer 28 is increased by 100 μs in step (54). Steps (53) and (54) are for correcting the lamp trigger timing in consideration of a voltage drop due to the ON/OFF status of the fixing heater 30. When it is determined that neither of the heater OFF switch flag F and the heater ON switch flag, F is set, the phase angle arithmetic operation flag F is checked in step (55). If the flag F is determined not to be set in step (55), the phase angle arithmetic operation flag F is set in step (56) and the next half cycle is controlled at the same phase of the previous half cycle. However, if the flag F is determined to be set in step (55), the phase angle of the next half cycle is calculated in accordance with the quotient N calculated in step (31). The phase angle is changed such that the turn-on voltage of the halogen lamp coincides with the input preset voltage once in each cycle, that is, every other half cycle of the power source frequency.

However, if it is determined in step (55) that the phase angle arithmetic operation flag F is set, the lamp voltage coincidence flag F is checked in step (57). If the flag F is determined to be set in step (57), the phase angle is not changed, and the next cycle is controlled with the same phase angle as that of the previous cycle. However, if it is determined in step (57) that the phase angle arithmetic operation flag F is set, the lamp voltage over flag F is checked in step (58). When the flag F is determined to be set in step (58), since the lamp voltage is higher than the preset value Hn, the preset value of the internal timer 28 is set to be larger than that for the previous cycle in accordance with the quotient N in steps 59 to 67. However, if it is determined in step (58) that the lamp voltage over flag F is not set, since the lamp voltage is smaller than the preset value Hn, the preset value of the internal timer 28 is set to be smaller than that for the previous cycle in steps 68 to 76. In this manner, through steps 59 to 67 or through steps 68 to 76, the correction coefficient is changed in accordance with the value of the quotient N, so that the turn-on voltage of the halogen lamp can be converged to the preset value Hn fast.

When the difference between the preset value Hn and the turn-on voltage is large, the correction amount of the phase angle is increased. However, if the turn-on voltage is close to the preset value, the correction amount is decreased, so that convergence of the turn-on voltage to the preset value Hn can be performed fast.

Since correction of the phase control angle by a predetermined amount is performed when the fixing heater is turned on or off, which may otherwise adversely affect the turn-on voltage of the exposure lamp, variations in the light amount of the fixing heater of the exposure lamp can be suppressed.

Temperature control of the fixing heater 30 associated with the phase control of the halogen lamp 2 will be described with reference to the accompanying drawings.

Figure 7:
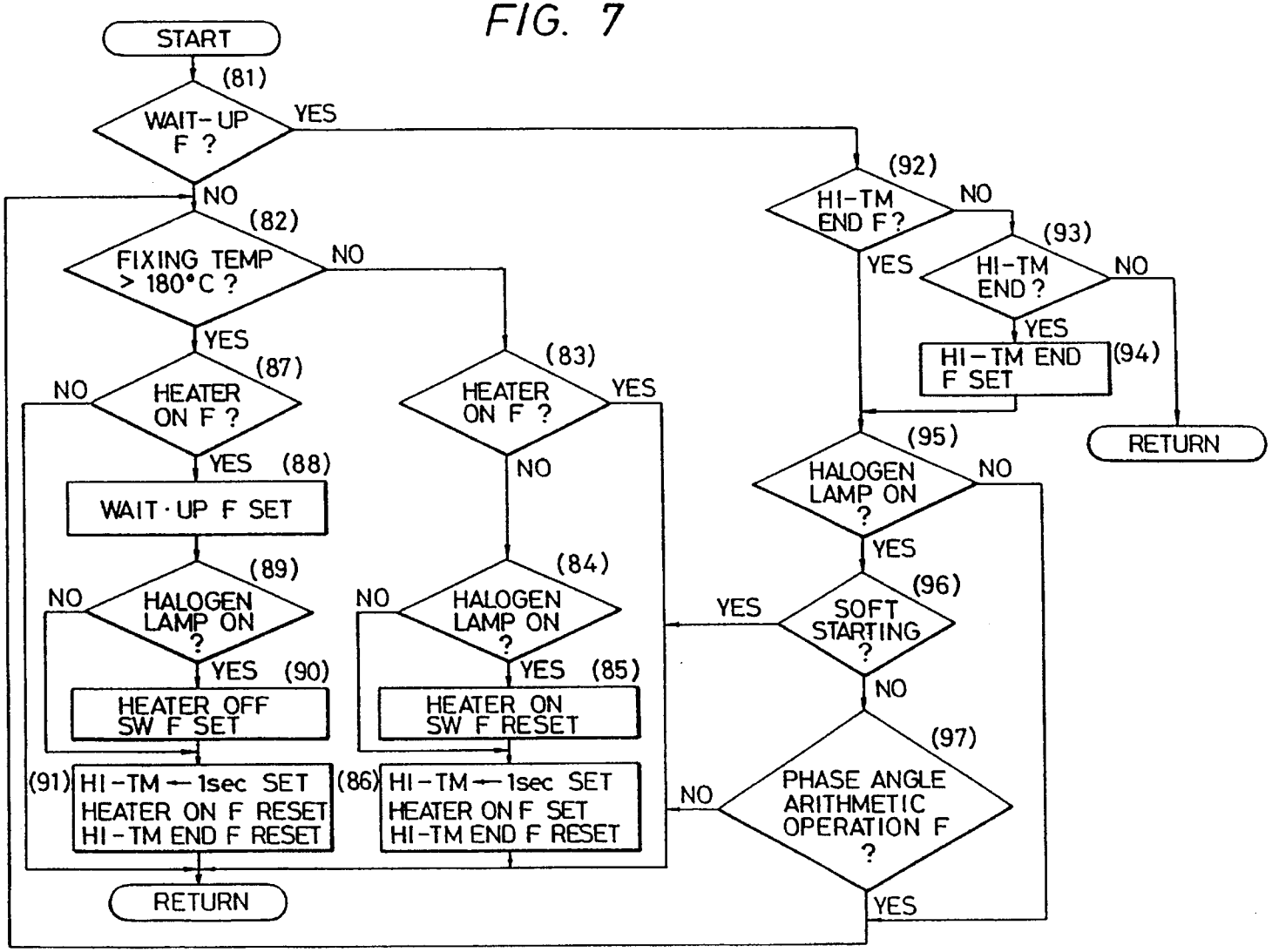
FIG. 7 is a flow chart of a temperature control sequence.

FIG. 7 is a flow chart of temperature control of the fixing heater 30.

Figure 8:
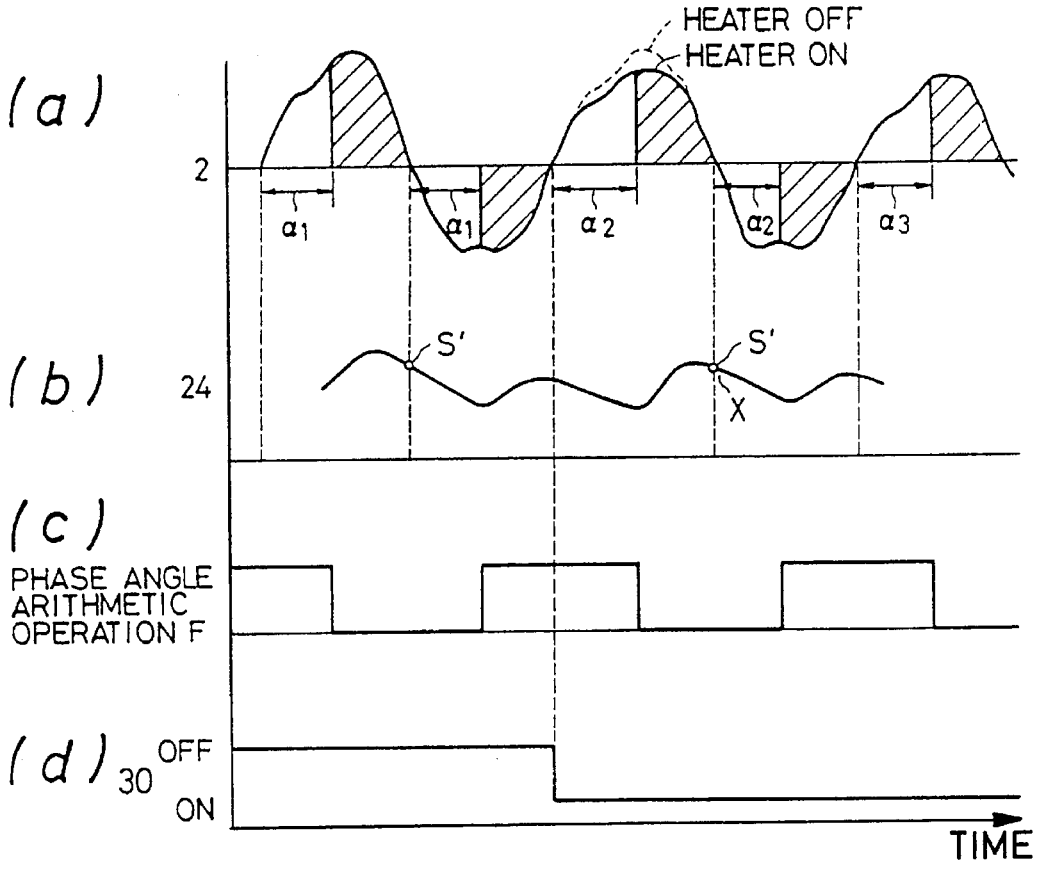
FIG. 8(*a–d*) is a timing chart for explaining the control sequence.

In FIG. 8(*a*) to (*d*) represent the control waveforms of the halogen lamp 2, the turn-on voltage monitor signal 24, the phase angle arithmetic operation flag F, and the fixing heater 30, respectively. The flow chart shown in FIG. 7 will be described with reference to the timing chart shown in FIG. 8.

When a roller surface temperature Lt reaches 180° C. after the power source is turned on, a wait-up flag F is checked in step (81). When the wait-up flag F is set (unless the halogen lamp 2 is turned on), the heater ON flag is set and a heater timer HI-TM as a one-second timer is started so as to turn on the fixing timer 30 when Lt<180° C. (steps (92), (95), (82), and (86)). When the roller surface temperature Lt exceeds 180° C. within 1 second of the heater ON time (that is, when the time of the heater timer HI-TM is up), the heater ON flag is reset to turn off the fixing heater 30 (steps (87), (88), (89), (90) and (91)). If the roller surface temperature Lt has not exceeded 180° C. within one second of the heater ON time, the heater ON flag is not reset and the ON time of the fixing heater 30 is held until Lt=180° C. in step (86).

Within 1 second of the turn off of the fixing heater 30, the roller surface temperature Lt is detected by the temperature detection signal 33. When it is determined that Lt<180° C. the heater ON flag is set, and the fixing heater 30 is turned on (steps (83), (84), (85), and (86)). However, if it is determined that Lt>180° C., the fixing heater 30 is kept OFF until Lt<180° C. The ON or OFF status of the fixing heater 30 is maintained for at least one second in accordance with temperature conditions.

When the halogen lamp 2 is turned on, the ON/OFF switching of the fixing heater 30 largely affects the turn-on voltage of the halogen lamp 2. Therefore, during the soft start (YES in step (96)), an advance to steps 82 to 91 is prohibited so as to prohibit ON/OFF switching of the fixing heater 30. Furthermore, even in a period other than the soft start, if the phase angle arithmetic operation flag F is set (YES in step (97)), the switching of the fixing heater 30 is enabled as needed.

In this manner, since ON/OFF switching of the fixing heater is prohibited during the operation of the soft start mechanism, an abrupt change in the turn-on voltage of the exposure lamp can be suppressed and convergence of the turn-on voltage of the exposure lamp to the target value can be performed fast.

Switching of the fixing heater 30 is allowed only when it is determined in step (97) that the phase angle arithmetic operation flag F is set, for the following reason. As shown in FIG. 8, sampling points S' of the turn-on voltage monitor signal 24 used for phase angle arithmetic operation have a period corresponding to one cycle of the power source frequency as described above. Therefore, if the fixing heater 30 is turned on at the timing shown in FIG. 8 and sampling of the turn-on voltage monitor signal 24 is performed at the next sampling point S' (point X), the turn-on voltage monitor signal 24 including a component influenced by the turning on of the fixing heater 30 is monitored. Thus, a phase angle $\alpha 3$ of the next cycle can be determined properly. For example, if the fixing heater 30 is turned on at the point X, the turn-on voltage will not include an influence of the turning on of the fixing heater 30 at the phase angle $\alpha 3$ of the next cycle. Then, convergence of the turn-on voltage of the halogen lamp 2 is delayed by one cycle. The turn-on voltage monitor signal 24 is sampled at each cycle for the following reason. When there is a difference between distortions of the positive and negative half cycles of the commercial power source voltage, more precise control can be performed if the turn-on voltage monitor signal 24 is detected in either half cycle.

In this manner, one of positive and negative half cycles of the commercial power source voltage is selected and ON/OFF switching of the fixing heater influencing the turn-on voltage of the exposure lamp is performed by the selected half cycle. Therefore, fluctuation in the turn-on voltage of the exposure lamp due to the nonsymmetrical distortion of the positive and negative half cycles of the power source voltage can be suppressed. Accordingly, variations in the light amount of the exposure lamp can be suppressed with good precision.

Figure 9:
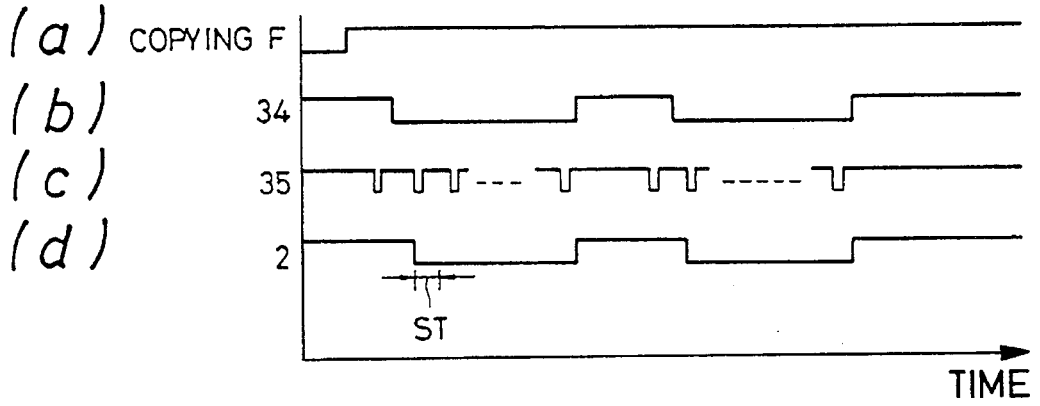
FIG. 9(*a–d*) is a timing chart of signals at the main components when two copies of a single original are produced.

FIG. 9 shows the waveforms of the main parts of the copying machine when two copies of a single original are to be produced. In FIG. 9, (*a*) shows the waveform of a copying flag F, (*b*) shows the waveform of the exposure signal 34, (*c*)

shows the waveform of the trigger signal 35, and (*d*) shows the waveform of the turn-on voltage of the halogen lamp 2. A soft start ST is performed at the start of the first copy production.

Measurements in phase control in accordance with the present invention will be described with reference to FIGS. 10 and 11.

Figure 10:
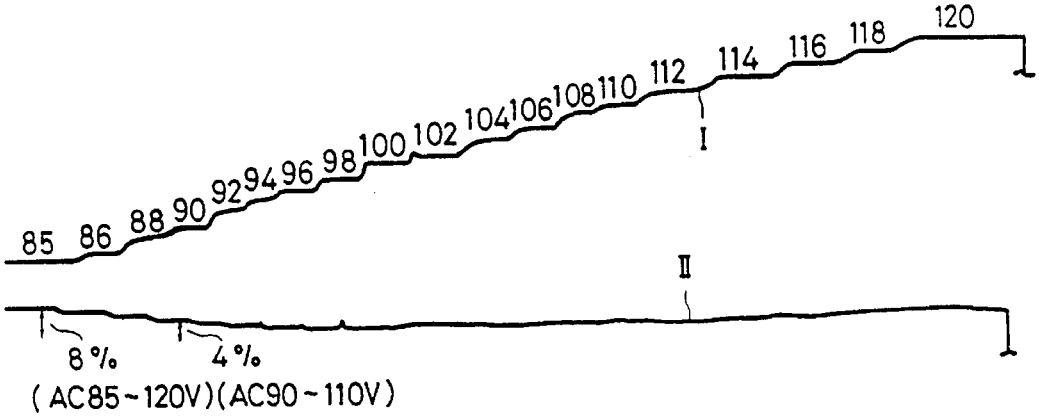
FIG. 10 is a graph showing variation characteristics of an input voltage vs. turn-on voltage of a halogen lamp.

FIG. 10 is a graph showing changes in power source voltage vs. light amount of the halogen lamp. Curve I shows the light source voltage, and curve II shows the light amount.

Figure 11:
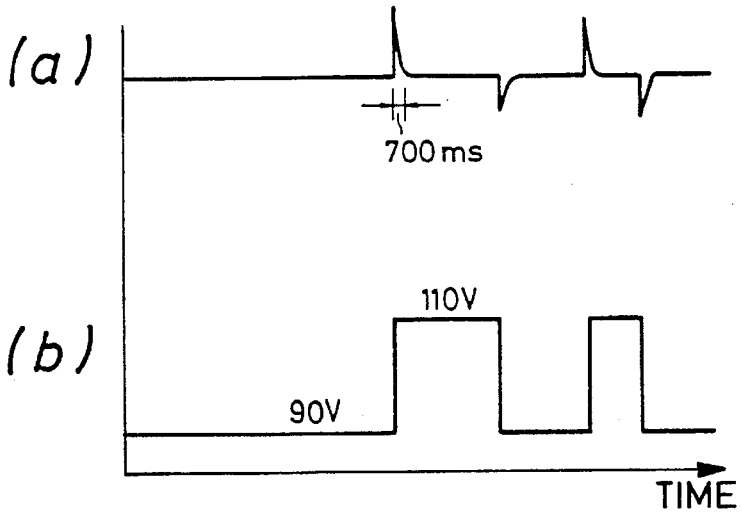
FIG. 11(*a* and *b*) is a chart showing response characteristics of an input voltage vs. turn-on voltage of a halogen lamp.

FIG. 11 shows the response time of the turn-on voltage of the halogen lamp vs. power source voltage. In FIG. 11, (*a*) shows the response time of the turn-on voltage of the halogen lamp 1, and (*b*) shows the voltage of the power source 1.

As can be seen from FIG. 10, the light amount variation of the halogen lamp 2 can be suppressed to 4% as compared to a variation of ±10% in the voltage of the power source 1, i.e., an AC voltage of 100 V.

As can be seen from FIG. 11, the response time of the voltage of the halogen lamp 2 for a voltage variation of ±10% for the voltage 100 V of the power source 1 is 700 ms which is relatively short.

As has been described above, an enlarged or reduced image of an original image can be reproduced by changing the scanning speed of the original and the focal distance of the lens for imaging in a copying machine. However, in this case, the amount of reflected light from the original to the photosensitive drum changes in accordance with a selected magnification. Therefore, if the light amount of the lamp is kept constant, the density of the electrostatic latent image is changed in accordance with the selected magnification. If the preset value Hn is changed in accordance with the selected magnification, the lamp light amount can be changed while the latent image density is kept constant, thereby constantly providing an image of excellent quality.

In the above description, the effective value of the turn-on voltage of the lamp is detected, and phase angle control is performed in accordance with the detected effective value. However, phase angle control can also be performed using a photodetector for detecting the light amount of the lamp. Furthermore, in place of the phase angle control, the voltage value itself or the duty ratio of a high-frequency voltage can be controlled. In addition, the present invention is not limited to a copying machine but can also be applied to control of an original exposure lamp of an apparatus for photoelectrically reading an image such as a facsimile system.

In this embodiment, a fixing heater of a copying machine is described as a load which influences the application voltage of the lamp. However, the present invention is not limited to this. The adverse effect on the lamp voltage of other load members other than the fixing heater such as a heating apparatus for the photosensitive drum, a dehumidifier heater for the drum, a dehumidifier for paper sheets, or a motor can be eliminated in a similar manner.

In the above description, the light amount of a lamp is preset, and control is performed to achieve this preset light amount. However, if the background of the original is not completely white or the image density is bright even if the background is white, the overall copied image may become dark or no image may be produced if the light amount is preset to be a predetermined value. Therefore, if the preset value Hn of the lamp can be adjusted by the operator in accordance with each different type of original, a copied image of excellent quality can be produced. However, such manual operation is cumbersome, and a unskilled operator may find it difficult to correctly perform the adjustment, thereby performing wasteful operation.

In view of this problem, an embodiment will be described below wherein a copying operation suitable for each different type of original can be performed without requiring manual operation by the operator.

Figure 1:
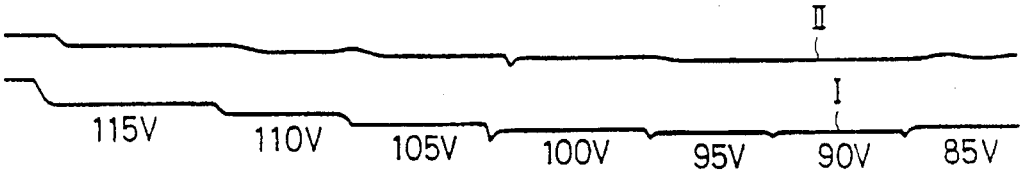
FIG. 1 (PRIOR ART)
FIG. 1 is a graph showing the variation characteristics of an input voltage vs. turn-on voltage of a halogen lamp.
Figure 12:
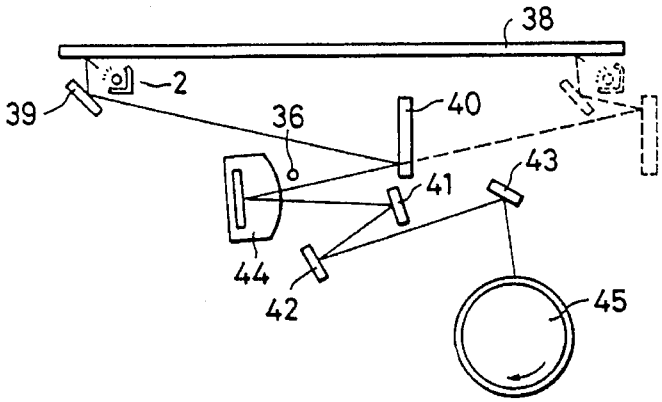
FIG. 12 is a sectional view of a main portion of a lamp control apparatus for explaining the original exposure state.

FIG. 12 is a sectional view for explaining the original exposure state. A photodetector element 36 is arranged below an original glass table 38 for placing an original to be exposed. Optical mirrors 39 to 43 direct the reflected light from the surface of the original. A mirror lens 44 directs the reflected light from the optical mirror 40 toward the optical mirror 41. A photosensitive drum 45 receives the exposure light through the optical mirror 43. The copying operation in this copying machine is the same as that described with reference to FIG. 1.

Figure 13:
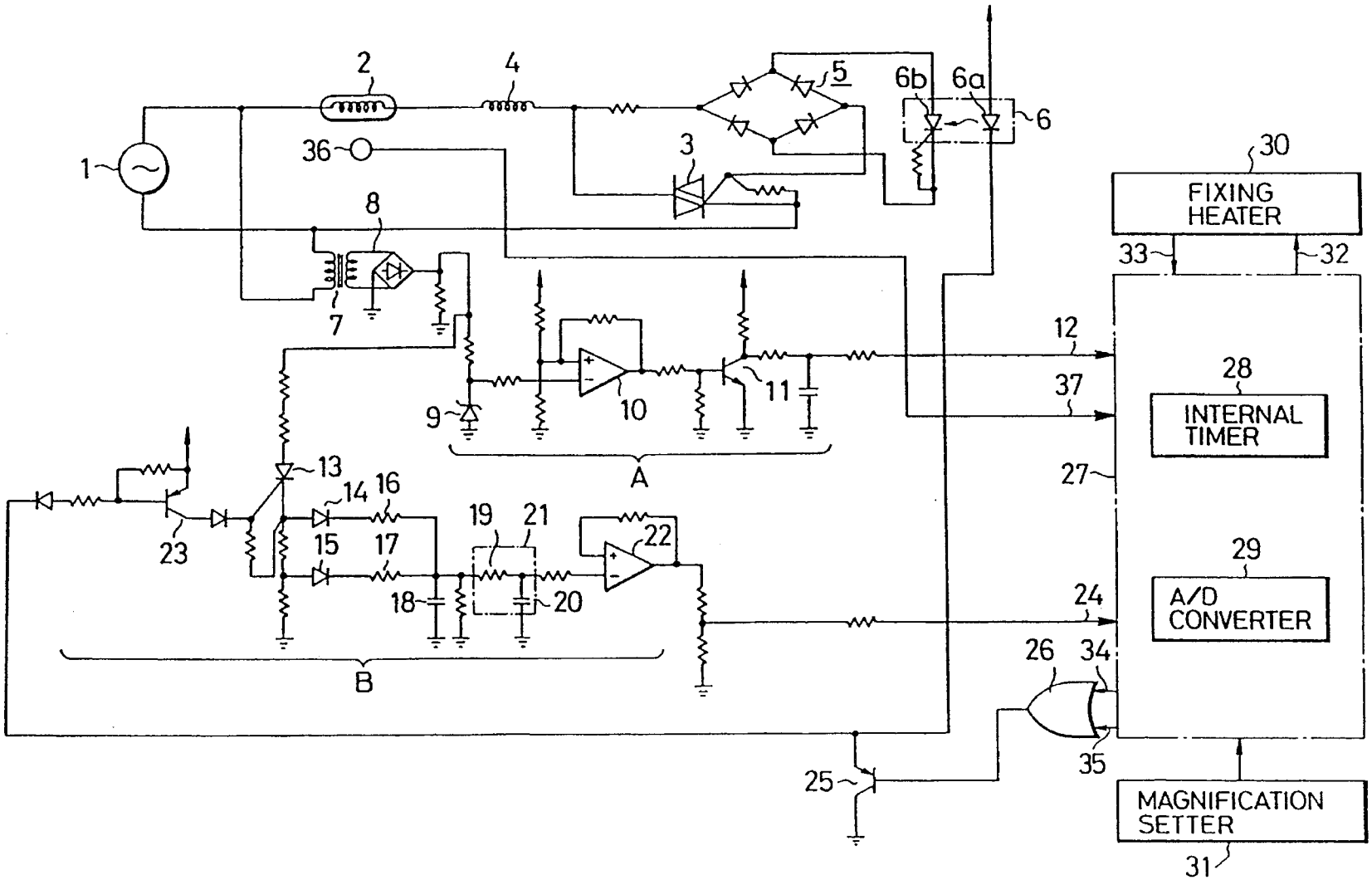
FIG. 13 is a circuit diagram of a circuit for lamp control in a copying machine having the construction as shown in FIG. 12.

FIG. 13 is a circuit diagram of a control circuit for lamp control in the copying machine having the construction shown in FIG. 12. Parts having the same functions as those shown in FIG. 3 are designated by the same reference numerals, and a detailed description thereof will be omitted. The copying machine shown in FIG. 13 is different from that shown in FIG. 3 in that the output from the photodetector element 36 is supplied to a microcomputer 27. The photodetector element 36 detects light reflected from the original surface (not shown) through a reflection mirror (not shown). A density signal 37 is then produced from the photodetector element 36. Those parts which are not described are not designated by reference numerals.

Figure 14:
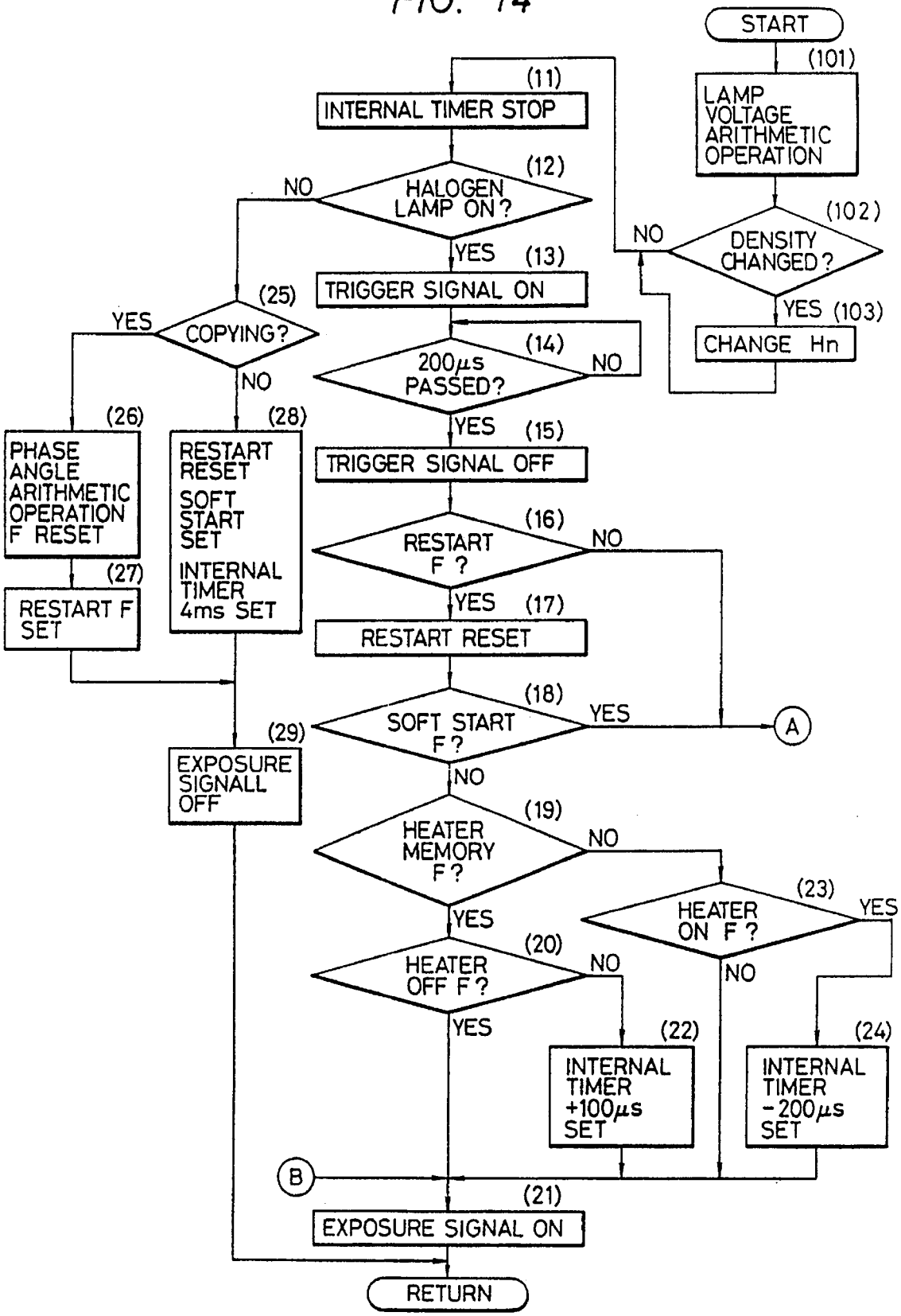
FIG. 14 is a flow chart showing an internal timer interruption routine in the circuit shown in FIG. 12.

FIG. 14 is a flow chart showing the operation of the circuit shown in FIG. 13 and replaces the flow chart showing an interruption operation using an internal timer, shown in FIG. 6(*a*). The flow chart shown in FIG. 14 is different from that shown in FIG. 6(*a*) in that steps from the start to the internal timer stop step are modified, but the remaining steps are the same.

The zero crossing interruption flow chart shown in FIG. 6, the flow chart shown in FIGS. 6(*b*) and 6(*c*) and the flow chart shown in FIG. 7 are the same as those for the circuit shown in FIG. 13.

When an interruption by an internal timer occurs, referring to FIG. 14, a lamp voltage arithmetic operation flow shown in FIG. 15 to be described later is executed in step (101). A need for changing a preset value Hn of a lamp turn-on voltage is checked for in accordance with a converted value ADn representing the original density. If the density must be changed, the present value Hn is changed to a value described with reference to FIG. 15, in step (103), and the flow jumps to step (11). However, if it is determined in step (102) that the preset value Hn need not be changed, the current preset value Hn is held and the flow goes to step (11).

In step 11 and thereafter, the same steps as the steps described with reference to FIG. 6(*a*) are executed, and the corresponding description should be referred to.

Figure 15:
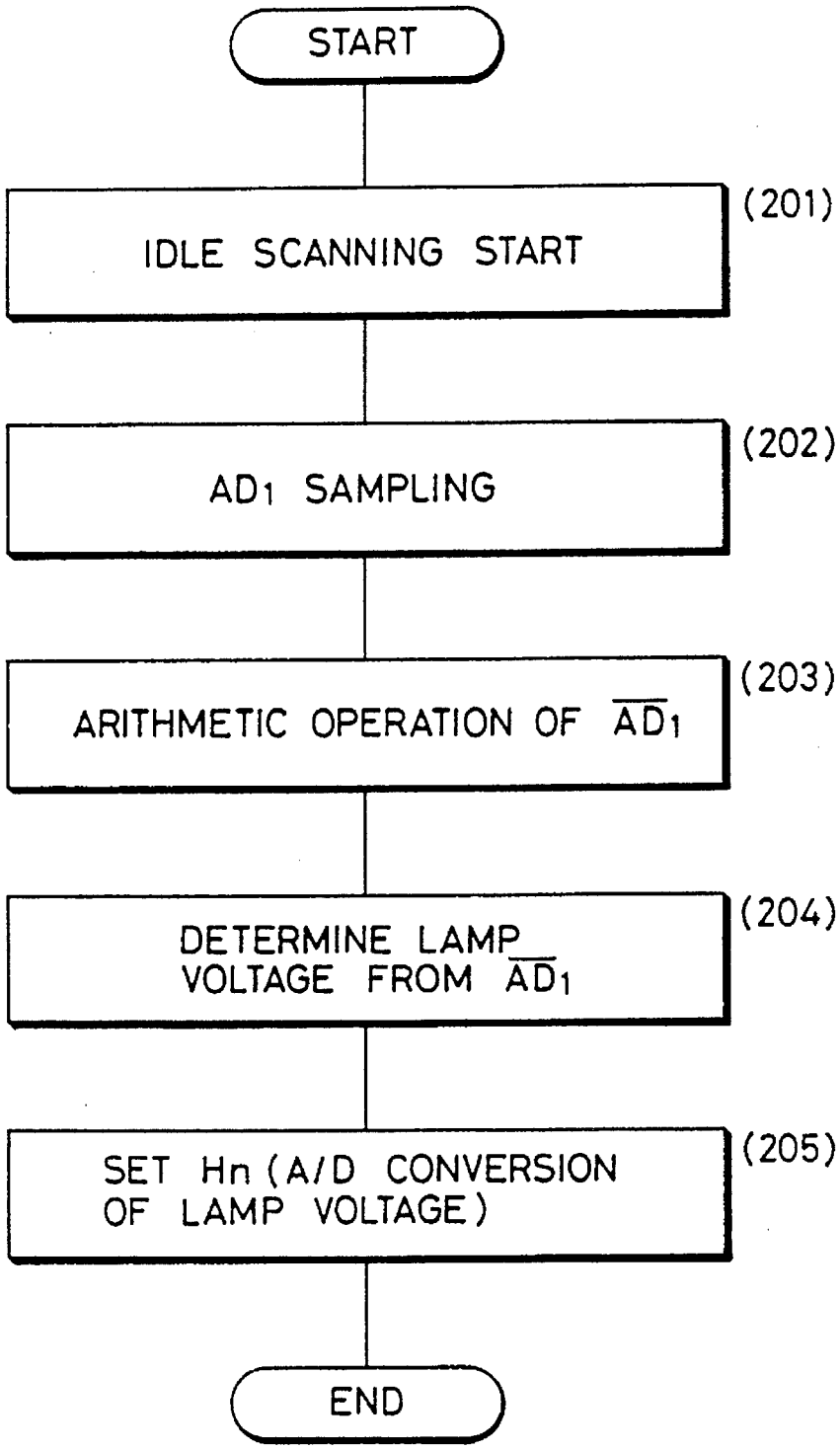
FIG. 15 is a flow chart showing a lamp voltage arithmetic calculation routine.

FIG. 15 is a flow chart of the lamp voltage arithmetic operation. Idle scanning start is executed at a predetermined light amount in step (201). As shown in FIG. 12, the density at a predetermined point of the original is sampled by the photodetector element 36 in step (202). The sampled Value is A/D converted to provide A/D converted values AD11 to AD1n which are averaged to provide an average value $\overline{AD1}$ in step (203). Then, the lamp voltage of the halogen lamp 2 is determined in correspondence with the average value $\overline{AD1}$ in step (204). The preset value Hn is determined in accordance with an A/D converted value of the lamp voltage of the halogen lamp 2 in step (205).

In this manner, the converted value ADn is calculated for each idle scanning, and the lamp preset value Hn is determined accordingly to perform suitable original exposure. Instead of detecting light reflected from the original in idle scanning, the potential of an electrostatic latent image formed on the photosensitive drum 45 may be detected, and the lamp voltage of the halogen lamp 2 can be determined in accordance with this detected potential. In this manner, according to the present invention, a preset original density is stored in advance, and the phase control angle of the power source voltage of the exposure lamp is controlled in accordance with the original density. Therefore, even if the density of the original varies, a stable density image can be obtained.

What is claimed is:

1. An apparatus for controlling an object to be controlled, said apparatus comprising:

detecting means for detecting a state of the object to be controlled;

first control means responsive to said detecting means for feed-back controlling the object to be controlled so that the object to be controlled is set to a predetermined state;

discriminating means for discriminating whether or not there occurs an event which causes a variation in the state of the object to be controlled; and second control means for controlling the object to be controlled so as to compensate the variation in the state caused by said event before the variation in the state caused by said event is detected by said detecting means.

2. An apparatus according to claim 1, wherein the object to be controlled is a light source.

3. An apparatus according to claim 1, wherein said detecting means detects a power supplied to the object to be controlled.

4. An apparatus according to claim 2, wherein said discriminating means discriminates whether or not there occurs a variation in power supplied to another load, which causes a variation in voltage of a power supply.

5. An apparatus according to claim 3, wherein said second control means controls a time for supplying a power from the power supply to the object to be controlled so that the power supplied to the object to be controlled may not be varied by the variation in voltage of the power supply caused by said event.

6. A method for controlling an object to be controlled, said method comprising the steps of:

detecting a state of the object to be controlled;

feed-back controlling, in response to the detecting step, the object to be controlled so that the object to be controlled is set to a predetermined state;

discriminating whether or not there occurs an event which causes a variation in the state of the object to be controlled; and controlling the object to be controlled so as to compensate the variation in the state caused by said event, before the variation in the state caused by said event is detected in said detecting step.

7. A method according to claim 6, wherein the object to be controlled is a light source.

8. A method according to claim 6, wherein said detecting step detects a power supplied to the object to be controlled.

9. A method according to claim 7, wherein said discriminating step discriminates whether or not there occurs a variation in power supplied to another load, which causes a variation in voltage of a power supply.

10. A method according to claim 8, wherein in said controlling step for compensating the variation in the state caused by said event, a time for supplying a power from the power supply to the object to be controlled so that the power supplied to the object to be controlled may not be varied by the variation in voltage of the power supply caused by said event.

11. An apparatus according to claim 5, wherein said detecting means detects an effective voltage applied to the object to be controlled, and said first control means controls a phase angle for phase control of an AC voltage supplied to the object to be controlled.

12. An apparatus according to claim 11, wherein said apparatus is a copying apparatus and the object to be controlled is a light source for exposing an original.

13. An apparatus according to claim 12, wherein said another load is a heater member for fixing an image.

14. A method according to claim 6, wherein in said detecting step, an effective voltage applied to the object to be controlled is detected, and in said control step, a phase angle for phase control of an AC voltage supplied to the object to be controlled is controlled.

15. A method according to claim 14, wherein said method is applied to a copying apparatus and the object to be controlled is a light source for exposing an original.

16. A method according to claim 15, wherein said another load is a heater member for fixing an image.

* * * * *

UNITED STATES PATENT AND TRADEMARK OFFICE

CERTIFICATE OF CORRECTION

PATENT NO. : 5,610,480

DATED : March 11, 1997

INVENTOR : Yoshiaki Takayanagi

It is certified that error appears in the above-identified patent and that said Letters Patent is hereby corrected as shown below:

On the title page:

Under [30] Foreign Application Priority Data,
"147291" should read --58-147291--;
"147300" should read --58-147300--; and
"147301" should read --58-147301--.

IN THE DRAWINGS

Sheet 5, Fig. 6(a) "SIGNALL" should read --SIGNAL--.

COLUMN 3

Line 32, "slits exposed" should read --slit-exposed--; and
Line 63, "Cleaning" should read --cleaning--.

UNITED STATES PATENT AND TRADEMARK OFFICE

CERTIFICATE OF CORRECTION

PATENT NO. : 5,610,480

DATED : March 11, 1997

INVENTOR : Yoshiaki Takayanagi

It is certified that error appears in the above-identified patent and that said Letters Patent is hereby corrected as shown below:

COLUMN 5

Line 2, "noninverting" should read --non-inverting--.

COLUMN 8

Line 42, "coincidence-flag" should read --coincidence flag-; and
Line 51, "lift" should read --life--.

COLUMN 9

Line 1, "flag, F" should read --flag F--; and
Line 51, "FIG. 8(a)" should read --FIG. #8, (a)--.

COLUMN 10

Line 7, "Lt<180°C." should read --Lt<180°C.,--.

UNITED STATES PATENT AND TRADEMARK OFFICE

CERTIFICATE OF CORRECTION

PATENT NO. : 5,610,480

DATED : March 11, 1997

INVENTOR : Yoshiaki Takayanagi

It is certified that error appears in the above-identified patent and that said Letters Patent is hereby corrected as shown below:

COLUMN 11

Line 13, "lamp 1," should read --lamp 2,--.

COLUMN 12

Line 39, "6," should read --6(a),--;
Line 48, "present" should read --preset--;
Line 54, "step 11" should read --step (11)--; and
Line 62, "Value" should read --value--.

Signed and Sealed this

Fourteenth Day of October, 1997

*Attest:*

*Attesting Officer*

BRUCE LEHMAN

*Commissioner of Patents and Trademarks*